United States Patent [19]

Pome'

[11] 4,335,365

[45] Jun. 15, 1982

[54] TEMPERATURE STABILIZED AND FREQUENCY ADJUSTABLE MICROWAVE CAVITIES

[75] Inventor: Enzo Pome', Sesto S. Giovanni, Italy

[73] Assignee: Telettra-Telefonica Electronica e Radio S.p.A., Milan, Italy

[21] Appl. No.: 190,566

[22] Filed: Sep. 25, 1980

[30] Foreign Application Priority Data

Oct. 15, 1979 [IT] Italy ..... 26491 A/79

[51] Int. Cl.[3] ..... H01P 7/06

[52] U.S. Cl. ..... 333/229; 331/107 DP; 333/231; 333/233

[58] Field of Search ..... 333/219, 222, 225, 226, 333/227, 229, 233, 234, 231; 331/107 DP

[56] References Cited

U.S. PATENT DOCUMENTS

| | | | |
|---|---|---|---|
| 2,716,222 | 8/1955 | Smullin | 333/229 |
| 3,063,030 | 11/1962 | Manahan et al. | 333/229 |
| 4,024,481 | 5/1977 | Kivi | 333/234 |
| 4,053,855 | 10/1977 | Kivi et al. | 333/227 X |
| 4,057,772 | 11/1977 | Basil, Jr. et al. | 333/229 |

*Primary Examiner*—Paul L. Gensler
*Attorney, Agent, or Firm*—Holman & Stern

[57] ABSTRACT

The invention concerns temperature stabilized resonant microwave cavities not requiring hermetic sealing and easy to be frequency adjusted, which essentially consist of a hollow body, a tuning screw, a plug and auxiliary lateral devices for coupling to the diode as well as of a termination, and are characterized in that the hollow body is filled with amorphous quartz. This hollow body consists preferably of an internal thin cartridge or vest made of precious alloy (Invar or Super Invar) forced into the hollow room of a thick support made of less precious material (aluminum).

4 Claims, 3 Drawing Figures

TEMPERATURE STABILIZED AND FREQUENCY ADJUSTABLE MICROWAVE CAVITIES

BACKGROUND OF THE INVENTION

The present invention relates to resonant cavities for microwaves which are temperature stabilized, do not require hermetic sealing, are easy to be frequency adjusted and comprise a hollow body, a tuning screw, a plug, auxiliary lateral devices for coupling to the diode and a termination. It is known that at present many types of microwave cavities are implemented. Among those with a metallic wall the most important ones are:

(1) TEM mode coaxial cavity;

(2) $TE_{10}$ mode waveguide cavity;

(3) $TE_{11}$ mode circular waveguide cavity;

(4) $TE_{01}$ mode circular waveguide cavity.

These cavities are implemented to form microwave circuits, viz.:

in stable oscillators they appropriately couple the cavities to the active circuit that generates oscillation so that the oscillator frequency is determined almost only by the cavity.

In the filters they appropriately couple a suitable number of cavities one to the other; particularly they couple the first cavity to the generator and the last one to the load. The biggest problem to be solved with such structures is the cavity resonance frequency stabilization upon a variation of environmental conditions (temperature and humidity) whenever a high frequency stability in the 1 ppm/°C. order is to be attained.

In fact, there generally are three fundamental factors affecting the resonance frequency of a cavity, viz.:

(1) Expansion due to temperature of the cavity's metal;

(2) Dielectric constant of the gas filling the cavity;

(3) Load impedance at the ports coupling the cavity to the outside.

As far as item (3) is concerned, the load affect becomes negligible by adequately reducing the coupling amount towards the load and, where necessary, by introducing an isolator between cavity and load.

As to item (1) it has already been suggested to manufacture the cavity body in a metal with a low expansion coefficient vs temperature e.g. in an iron-nickel alloy known under the commercial names of Invar and Super Invar with an expansion coefficient less than/equal to 1.5 ppm/°C. and less than/equal to 0.7 ppm/°C., respectively.

In addition a particular heat treatment for stabilization of these materials are previewed before and after their being worked. In this way also the end product maintains the expansion coefficient values specified.

Finally concerning item (2) it is necessary to hermetically seal the cavity (i.e. it must be moist- and gasproof) before filling it with a dry inert gas (e.g. nitrogen) thus cancelling the difference in pressure with respect to the external environment.

This solution is particularly hazardous as all soldering of the several parts constituting the cavity as well as the coupling irises and tuning adjustments must be sealed. At first object of this invention is to provide a cavity that does not present the mentioned inconveniences, whilst it is temperature stabilized with very simple and efficient means. A second object of the invention is to provide a cavity which not only is efficiently stabilized in temperature, but can also be easily frequency adjusted.

SUMMARY OF THE INVENTION

These and other objects are attained with a cavity which presents a hollow body of any of the four modes mentioned before, said body being made of an alloy with a very low thermal expansion e.g. an iron-nickel alloy (preferably an "Invar" or "Super Invar" alloy), the air contained in the cavity being practically eliminated, as according to this invention, an amorphous quartz is introduced into said cavity hollow body.

The form and size of this quartz preferably must be so as to get restrained into the hollow body thus reducing to a minimum those areas wherein any air leaks might remain.

According to a feature of the invention, this amorphous quartz is preferred to be of an optical quality, even if a non optical quality may be advantageously implemented for cavities with frequencies less than 2 to 4 GHz, at which the losses are low and thus not determinant.

Moreover, as at said frequencies less than 2 to 4 GHz the cavities are relatively bigger, the possibility of using a non optical quartz (which is less expensive) leads to a considerable cost saving, as the use of cheap material actually shows up when more quartz is needed.

According to a further feature of the invention, the upper free circular face of the quartz cylinder is opposite the terminal rod carried by a section of the tuning screw and is made of aluminum or any other material whose expansion coefficient is greater with respect to the iron-nickel alloy (Invar), so that it behaves as a compensator for the resonance frequency vs temperature. Another substantial advantage of the invention derives from the fact that the resonance frequency range is selected by varying the quartz cylinder height (which, at a parity of diameter, changes the cavity volume), i.e. by substituting a cylinder of a certain height by a cylinder of a different height, and by consequently changing the adjusting screw.

BRIEF DESCRIPTION OF THE DRAWINGS

The several aspects and advantages of the invention are better evidenced by the following description of the preferred embodiments represented in the attached drawings, FIG. 1 of which is an exploded prospective view of a cavity of this invention, whilst

DESCRIPTION OF THE PREFERRED EMBODIMENT

As results from these figures the cavity consists of actual hollow body designated A, plug B, tuning screw C and of side couplings a2 and a7.

Actual cavity body A is preferred to be obtained from an iron-nickel alloy bar having a very low expansion (i.e. Invar or Super Invar) by means of milling and turning.

However, it can also be made in two partial bodies, i.e. a first thin body which is made of Invar or Super Invar and forms the internal part or vest or cartridge of the cavity and an external body which is made of a less precious metal such as aluminum, and receives said internal vest of Invar or Super Invar.

Independently of the cavity construction, cavity body A presents on its upper face f1 a threaded hole a1 wherein lower threaded part b1 of plug B is screwed.

Its front face f4 (FIG. 1) is provided with four holes designated as a5 as well as with slot a4 for the load of circular iris a3, whereas opposite circular iris a3 there is a coupling iris for the circuit and the GUNN diode. Side faces f2 and f3 are fitted with traditional lateral couplings for termination and the GUNN diode input.

These couplings may be any conventional type and do not affect whatsoever the fundamental aspects of the invention, but their detailed description is considered unnecessary.

Figure 1:
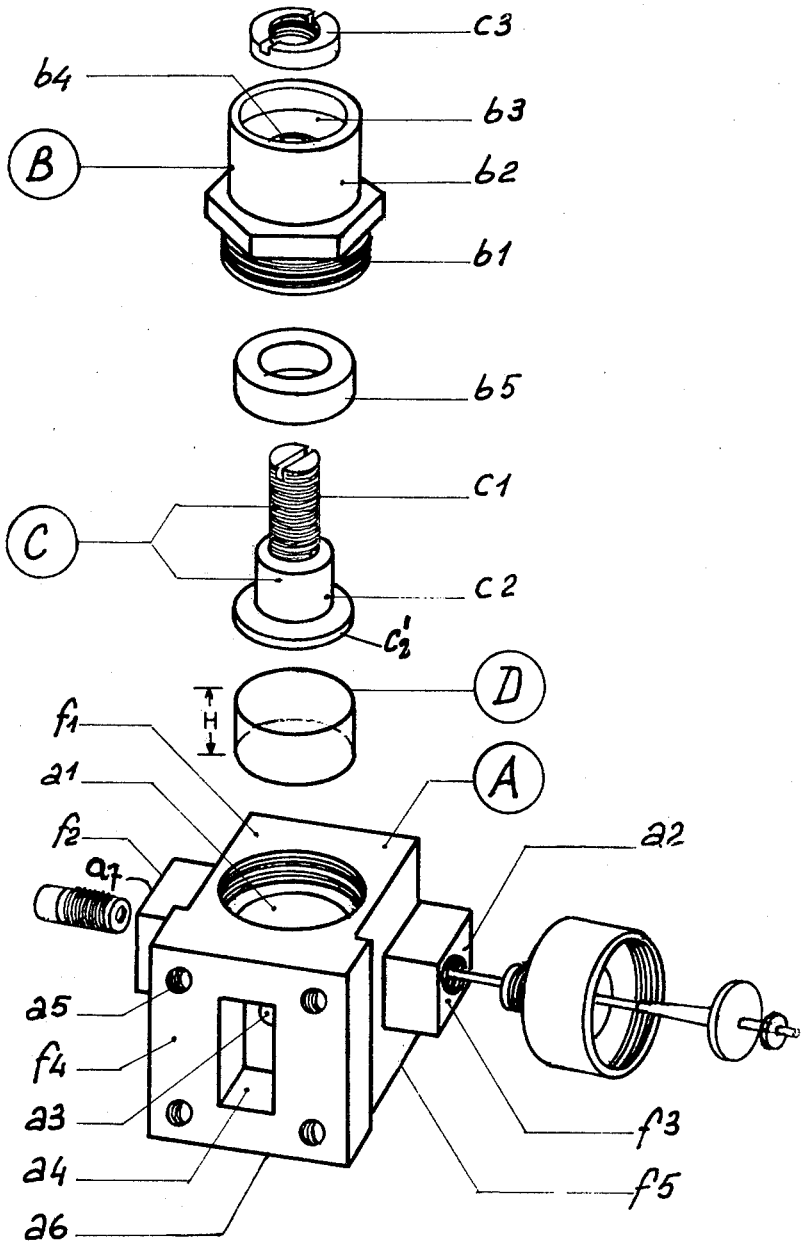

In fact, the invention previews the filling of hollow part a1 of body A with an amorphous quartz marked with D in FIG. 1 and having a cylindrical shape with an external diameter which substantially is equal to the internal diameter of cavity a1 of body A.

Figure 2:
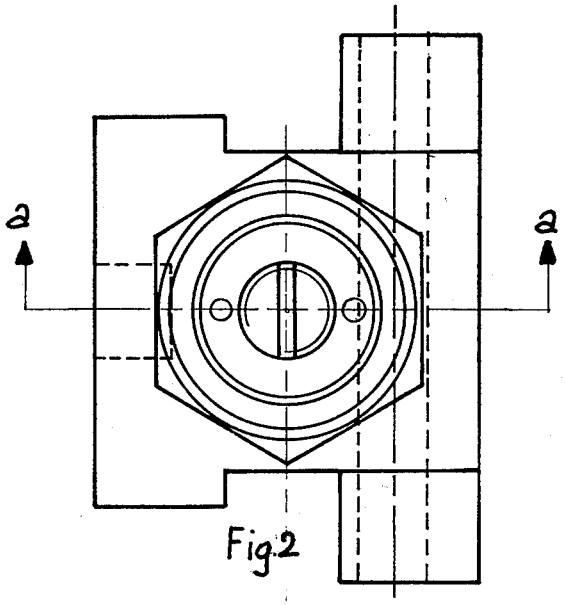
FIG. 2 is a top view.
Figure 2A:
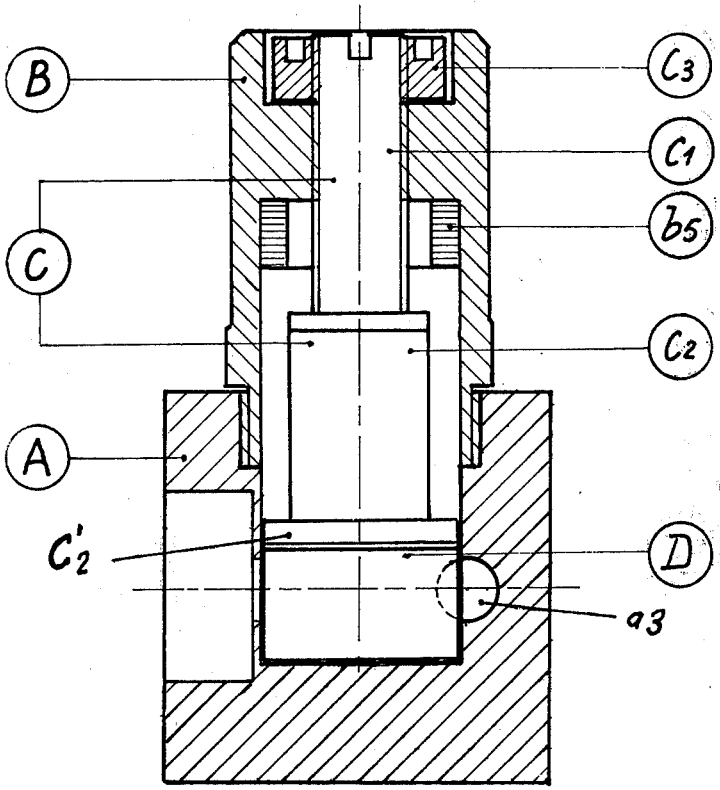
FIG. 2*a* instead is a partial cross-section of said cavity with a vertical plane plotting line a—a of FIG. 2.

In the very simple and advantageous embodiment shown in FIGS. 1 and 2, cylinder D is obtained by working the quartz as a separate block and is inserted under low pressure into the metallic cavity in order to minimize those areas where air leaks are likely to be held.

The amorphous quartz characteristics are known (refer e.g. to the Technical Leaflet of ELECTRO QUARTZ).

Among these characteristics, the most outstanding ones are related to the expansion coefficient which is less than 1 ppm/°C., which is almost the same as Invar's expansion coefficient, and to the loss factor which up to 13 GHz is very good, whilst it is acceptable for applications up to over 20 GHz.

In the preferred embodiments of the invention, amorphous quartz D is shaped as an extremely compact plane bar without air bubbles.

The separate preshaped bar not only has the advantage of being free of air bubbles (which might occur if cast quartz were introduced into cavities a1 of A), but also of eliminating residual air leaks in A1, in that it is being forced into a1 thus fixing it inside A. Bar D is preferably prepared by starting from round bars or commercial transparent quartz rods which are likely to present striations due to air bubbles.

Therefore these rods are rectified by a diamond grinding wheel so that their external diameter is brought as near as possible to the internal diameter of cavity a1.

Then the rectified rod is cut into small cylinders having the required heights. The cylinders are again rectified and lapped by a diamond grinding wheel so long as the required height is reached.

Tuning screw C is made up of two parts:—threaded part C1 turning the screw into the entirely threaded holder (under b1 shown in FIG. 1) of plug B and, just like plug B itself, it is made of Invar;—part C2 is made of aluminum or other material with a higher expansion coefficient than Invar's and it acts as a compensator for the resonance frequency vs temperature.

The diameter of C2 is greater than that of C1, whilst C2 terminates with a wider disk C'2, which is coupled to the free upper face of D (FIG. 2).

Finally counter nut C3 blocks tuning screw C on plug B, which on its turn is locked to A with its external threaded part b1. Sleeve b5 made of absorbing material damps any spurious resonances of the cavity.

A very important advantage of this invention lies in the fact that the cavity's resonance frequency range can be easily varied by replacing a quartz cylinder of a certain height by another cylinder of a different height (which changes the cavity volume), and as a consequence replacing the original tuning screw by a screw compatible with the height of the new cylinder. It has indeed been found that the frequency range is substantially selected depending on height H of quartz cylinder D (with the same diameter) and on the dimensions of tuning screw C, particularly of the diameter of disk-rod C'2, of the diameter of threaded part C1 and of the total height of C. The frequency range may also be made dependent upon the more outstanding sizes of plug B and absorber b5.

By making the frequency range dependent upon the height of the quartz cylinder and upon the sizes of tuning screw C, the advantage is attained that with one single cavity it is sufficient to change the quartz cylinder and the screw so as to vary the frequency range. In this way, with quartz cylinders with a fixed diameter, e.g. 15 mm, but of 4 different heights it is possible to change from the 12.700–12.850 GHz range to other ranges such as 12.850–13.000, 13.000–13.150 and 13.150 to 13.300 GHz, thereby changing each time also the compensator rod.

The resonance frequency stability of the cavities according to the invention is characteristically ±40 ppm from 0° to 45° C.

Among the fundamental advantages achieved with the solution of this invention we quote the following ones:

(a) a hermetic sealing of the cavity is no longer necessary, as the air contained internally is being reduced to a negligible quantity, whereas the cast quartz is not air tight.

(b) The tuning screw is no longer sealed, and thus it is normally accessible during the cavity operation. In this way it is possible to periodically recover the long term cavity frequency drift, which was almost impossible with a hermetically sealed cavity.

(c) The sizes of the metallic cavity filled with quartz are halved with respect to a cavity full of gas, which means material saving and smaller sizes.

These fundamental features lead to other advantages which are listed below:

(d) Drastic cost saving, as the sealing cycle is no longer required and less Invar is needed.

(e) Longer lifetime of the cavity, because the sealing losses, even the smallest ones, have been eliminated, whereas long term cavity deviations can be recovered by adjusting the tuning screw whose field access is now possible.

(f) Less spare parts for cavity oscillators, since one single cavity can be tuned on the field within a certain sub-range, whereas hermetically sealed cavities required as many cavity oscillators as were the channel frequencies.

(g) Active elements in the cavity can be directly replaced without the need of repeating the cavity alignment cycle, as was used to be done with hermetically sealed cavities. So if e.g. the diode burns it can be replaced by substituting the diode holder, but the cavity according to the invention is neither replaced nor undergoes long sealing and stabilization operations.

(h) As mentioned above, the use of a quartz cylinder according to the invention allows also for an advantageous construction of cavity body A, by assembling two partial bodies (not shown but easy to be imagined); an internal body which is made of a precious alloy having a very low thermal expansion coefficient (Invar or Super Invar) in the form of a shell or cartridge constituting the internal vest of the hollow cavity and thus delimitating its internal critical room, and an outer body which is made of less precious metal, e.g. aluminum and receives the internal body. The latter has a minor thickness (shell) over the major thickness of the outer body which absorbs all the mechanical stress and protects the thin internal vest forced under pressure in the outer body. Consistent savings in precious alloy (Invar) are anyway attained thanks to air reduction inside the internal body caused by the presence of the quartz cylinder according to the invention.

The construction of body A by a thin internal cartridge in precious alloy and by a thick outer support in less precious metal (aluminum) is now possible as it has been found that: (1) at low temperatures the outer aluminum body compressing internal the "Invar" vest cannot appreciably deform the vest; (2) at higher temperatures, expansion of the internal body does not get obstructed by the outer aluminum body as the latter has a higher thermal expansion coefficient.

I claim:

1. A frequency adjustable, highly temperature-stabilized resonant wave guide cavity for microwave oscillators, comprising:

a metal body having a hollow cylindrical interior with a predetermined inside diameter forming said cavity;

a tuning screw extending into said cavity;

a plug member threadedly engaging said body and through which said tuning screw extends;

a first lateral coupling member for coupling a diode to said cavity;

a second lateral termination coupling; and a preformed solid cylinder of amorphous quartz having an outer diameter substantially equal to the predetermined inside diameter of the hollow metal body interior and disposed in said cavity, said quartz cylinder filling said cavity to a height which determines the resonant frequency of the cavity and being replaceable with other quartz cylinders of different heights.

2. The cavity according to claim 1 wherein said amorphous quartz is of optical quality.

3. The cavity according to claims 1 or 2 wherein the tuning screw is readily accessible from outside of said metal body as opposed to being sealed.

4. The cavity according to claims 1 or 2 wherein the tuning screw comprises a first threaded part made of an alloy having a low thermal expansion coefficient, and a second part made of a material having an expansion coefficient which is greater than that of the first part so that the tuning screw serves as a compensator for the resonant frequency as a function of temperature.

* * * * *